United States Patent [19]

Watts

[11] Patent Number: 4,620,475

[45] Date of Patent: Nov. 4, 1986

[54] HYDRAULIC DISPLACEMENT UNIT AND METHOD OF ASSEMBLY THEREOF

[75] Inventor: Thomas A. Watts, Ames, Iowa

[73] Assignee: Sundstrand Corporation, Rockford, Ill.

[21] Appl. No.: 779,389

[22] Filed: Sep. 23, 1985

[51] Int. Cl.[4] ..... F01B 13/04

[52] U.S. Cl. ..... 91/499; 92/57; 92/128; 29/156.4 R

[58] Field of Search ..... 91/499, 507; 92/57, 92/71, 128; 417/269; 29/156.4 R

[56] References Cited

U.S. PATENT DOCUMENTS

| | | | |
|---|---|---|---|
| 3,382,793 | 5/1968 | Gantzer | 91/507 X |
| 3,808,949 | 5/1974 | Muncke et al. | 91/473 |
| 4,207,804 | 6/1980 | Fukui | 91/499 |
| 4,444,093 | 4/1984 | Koga et al. | 91/507 X |
| 4,550,645 | 11/1985 | Beck, Jr. | 91/499 |

OTHER PUBLICATIONS

Air Force Technical Report, dated Aug. 1973, #AFA-PL-TR-73-65 (cover sheet, Foreward, pp. 81-92; 108; 110).

*Primary Examiner*—William L. Freeh
*Assistant Examiner*—Paul F. Neils
*Attorney, Agent, or Firm*—Wood, Dalton, Phillips, Mason & Rowe

[57] ABSTRACT

A hydraulic displacement unit of the axial piston fixed displacement type having a rotatable cylinder block with axially reciprocal pistons, each of which has a slipper associated with a swash surface, as defined by a thrust plate, and structure for obtaining fixed maximum clearance between the slippers and the thrust plate. This fixed maximum clearance is achieved by the use of the controlled positioning of a slipper retainer bearing relative to the surface of the thrust plate by use of a tubular member positioned within the cavity of the unit housing which is securely located and positioned by assembly of an end cap to the housing to be located between the thrust plate and the end cap. The tubular member has a series of windows at the thrust plate end thereof for receiving outwardly-extending peripheral tabs on the slipper retainer bearing to control the distance of the slipper retainer bearing from the thrust plate and with the thickness of the slipper retainer bearing, a slipper retainer, and slipper feet determining the fixed maximum clearance. The tubular member is constructed with permanently deformable fingers to take up manufacturing tolerances between components upon assembly of the unit and has provision for optional mounting of different types of spring structures acting on the slippers for urging the slippers toward the thrust plate and resisting tipping thereof.

35 Claims, 18 Drawing Figures

HYDRAULIC DISPLACEMENT UNIT AND METHOD OF ASSEMBLY THEREOF

DESCRIPTION

1. Technical Field

This invention pertains to a hydraulic displacement unit and method of assembly thereof and, more particularly, to an axial piston unit of fixed displacement and operable as either a pump or a motor. The unit has a rotatable cylinder block with a plurality of axially reciprocal pistons, each having a slipper with a slipper foot engageable with a swash surface for controlling the stroke of the piston and structure including an annular slipper retainer bearing for maintaining a fixed maximum clearance between the slippers and the swash surface. The foregoing components of the unit as well as the remainder of the components which may include a thrust plate defining the swash surface and a valve plate are readily assembled for association with a housing having a cavity and an end cap for closing the cavity, with interfitting shapes on the various parts to assure assembly of the components in the proper positions and orientation, without the use of any fastening elements, other than fastening means which hold the end cap and housing in assembled relation with the remaining components held therebetween within the housing cavity.

2. Background Art

Hydraulic displacement units, in the form of an axial piston unit operable as either a pump or a motor, are well known in the art. The axial piston hydraulic displacement unit has a rotatable cylinder block mounted within a housing cavity and carries a plurality of axially reciprocal pistons, each having a slipper at an end thereof for coacting with a swash surface disposed at an angle to the axis of rotation of the cylinder block and which controls the reciprocal stroke of the pistons. The slippers can operate against a swash surface formed integrally with the housing or against a swash plate mounted in the housing and, in either case, a thrust plate can be positioned against the angled surface for engagement by the feet of the slippers.

It is conventional in such a hydraulic displacement unit to utilize an annular slipper retainer having a shape resembling that of a telephone dial, with a number of openings to each partially or completely surround a slipper and engage against the side of the slipper feet remote from the swash surface which maintains the orientation of the slippers as the cylinder block rotates. Additionally, lift-off of the slipper feet from the swash surface, such as defined by the thrust plate, is typically controlled either by an annular slipper retainer bearing engaging the annular slipper retainer or by the use of springs.

Fixed clearance of the slippers relative to the swash plate has been achieved by the use of bolts which attach the slipper retainer bearing to the swash surface. A fixed maximum clearance structure providing for an attachment of a slipper retainer bearing to a housing by bolts is shown in the Kline Pat. No. 4,426,914. A structure of this type requires an enlarged cavity within the housing to provide space for the bolts as well as access thereto by a tool, such as a wrench. Such a design is sensitive to the integrity of the bolts, since the failure of a bolt, as by backing-out, could typically cause catastrophic failure of the hydraulic displacement unit. Additionally, there is normally the requirement that the housing for the unit be made longer to provide the necessary depth for the attaching bolts. The increased diameter of the cavity to accommodate the bolts and the tool clearance results in increasing the span required for the end cap to close the cavity in the housing, with the increased span resulting in an increased span for peripherally-disposed hold-down bolts between the end cap and the housing. This increased bolt span affects end cap deflection and can result in adverse effects on both internal and external leakage and efficiency.

Spring-biasing of the slippers against the swash surface requires a number of parts. An example of a spring hold-down structure is shown in the Gantzer Pat. No. 3,382,793, owned by the assignee of this application, which shows a spherical retainer 60 urged against a slipper retainer 66 by a plurality of return springs 61 mounted in recesses in a cylinder block 40.

Another construction of a hydraulic displacement unit providing for fixed clearance of the slippers relative to the swash surface is known in the art wherein a tube spring surrounds the cylinder block and with an angled adapter acts between an end cap for the housing and a machined rihg which engages an annular slipper retainer member and the swash surface. The tube spring is placed under compression by assembly of the end cap to the housing and acts to take up tolerances.

DISCLOSURE OF THE INVENTION

A primary feature of the invention is to provide a new and improved hydraulic displacement unit of the axial piston fixed displacement type operable either as a pump or motor and having components which are readily assembled by a successive build-up of components which are structurally interrelated to assure correct assembly and achieve alignment of components and with the entire assembly held in assembled relation by attachment of an end cap to a housing having a cavity in which the components are mounted.

Another feature of the invention is to provide a hydraulic displacement unit, as defined in the preceding paragraph wherein the hydraulic displacement unit has a rotatable cylinder block mounted within a cavity of a housing and which has a series of axially reciprocal pistons, each having a slipper for coaction with a swash surface, and means for achieving a fixed maximum clearance between the feet of the slippers and the swash surface by means of a tubular member mounted within the cavity and fixed in position therein by closure of the end cap onto the housing to have an end thereof engaging a swash surface of the unit and having means at said end coacting with peripheral tabs on an annular slipper retainer bearing to have the slipper maximum clearance controlled by the axial location of the retainer bearing relative to the swash surface and the thickness of the slipper feet, the slipper retainer and the bearing therefor.

Another feature of the invention is to provide an assembly method for the components of the hydraulic displacement unit defined above wherein the components can be successively assembled on an end cap of the unit and properly oriented, one relative to the other, followed by the placement of the housing having the cavity over the components and against the end cap followed by drawing the end cap and housing together to complete the assembly which, in the process of so doing, deforms the tubular member disposed between the end cap and the swash surface and which has the windows coacting with the peripneral tabs of the annular slipper retaining bearing to provide the fixed maximum clearance between the slippers and the swash surface.

Another object of the invention is to provide an axial piston fixed displacement unit operable as either a pump or a motor and which has components which can be assembled and held in position within a housing cavity solely by attachment of the housing to an end cap which results in a smaller over-all size of the unit, by avoiding the need for sizing the housing cavity to receive component attaching bolts and clearance for tool access thereto and which, therefore, reduces the span of the end cap required to provide for means for attaching the housing and end cap together to result in less end cap thickness being required for the necessary strength requirements.

An object of the invention is to provide a hydraulic displacement unit providing for internal retention of swash surface engaging slippers in a fixed maximum clearance relation with the swash surface by means of a tubular member located within the cavity of a housing for the unit and having one end firmly pressed against the swash surface and the other end adjacent an end cap for closing the housing cavity with means associated with the tubular member operable upon securing the end cap to the housing to take up manufacturing tolerances, and the opposite end of the tubular member has a series of peripherally-spaced windows for receiving tabs on an annular slipper retainer bearing which engages against an annular slipper retainer and with the fixed maximum slipper clearance then being controlled by the thickness of the slipper retainer bearing, the slipper retainer and the slipper foot relative to the height of the window at the end of the tubular member.

Another object of the invention is to provide a hydraulic displacement unit, as defined in the preceding paragraph wherein the windows in the end of the tubular member can be peripherally spaced in such a manner and associated with a similar peripheral spacing of the tabs on the slipper retainer bearing to prevent upside down installation of the slipper retainer bearing.

Still another object of the invention is to provide spring means associated with the tubular member for optionally providing a spring load on the slippers and with spring-receiving recesses associated with the windows in the end of the tubular member facilitating the mounting of the spring or springs to act on the annular slipper retainer bearing.

Still another object of the invention is to provide a hydraulic displacement unit as defined in the preceding paragraphs and additionally having a valve plate positionable between the end cap and the rotatable cylinder block mounting the axially reciprocal pistons and the housing cavity internal wall is contoured to facilitate assembly of the unit components by a buildup thereof on the end cap followed by enclosing of the components within the housing cavity which is attached to the end cap. The swash surface is defined by a thrust plate which has slots to coact with aligning tabs on an end of the tubular member having the windows and the thrust plate has a projection to fit within an alignment recess in the housing for rotational orientation of the housing relative to the thrust plate upon the final assembly of the housing to the end cap. Shoulders on the internal wall of the housing cavity radially locate the tubular member and the thrust plate and provide reaction surfaces against internal forces.

An additional object of the invention is to provide a hydraulic displacement unit of the fixed displacement type having a housing with a cavity, a rotatable cylinder block in said housing cavity and carrying a plurality of pistons axially reciprocable in chambers in said cylinder block as the cylinder block rotates, an inclined swash surface at one end of said cavity, an end cap for closing said cavity, means for securing said end cap to said housing, a slipper associated with each of said pistons and each having a slipper foot engageable with said inclined swash surface for controlling the axial stroke of said pistons, an annular slipper retainer bearing, an annular slipper retainer associated with said slippers and captured between said annular slipper retainer bearing and the slipper feet, a plurality of peripheral tabs on said annular slipper retainer bearing, and a tubular member captured between said swash surface and said end cap and coacting with said tabs to provide a fixed maximum clearance between the slippers and the swash surface.

A further object of the invention is to provide a hydraulic displacement unit comprising, a housing with a cavity and with an internal inclined wall at one end of the cavity, a thrust plate positioned against said internal inclined wall to define a swash surface and having a projection with a slot and at least one additional slot generally diametrically opposite thereof, a cylinder block on a rotatable shaft with a plurality of axially movable pistons extending from said cylinder block and each having a slipper with a foot engaging said swash surface, an annular slipper retainer for engagement with said slippers, an annular slipper retainer bearing for holding said annular slipper retainer against said slipper feet and having a plurality of outwardly-extending peripheral tabs, a tubular member having aligning tabs extending from each end thereof with the aligning tabs at one end positioned in the slots of the thrust plate and having windows to receive the peripheral tabs of the annular slipper retainer bearing, the aligning tabs at the other end of the tubular member being interspersed with deformable fingers, an end cap for closing said cavity, a valve plate positioned between the end cap and the housing and having a pair of ears with slots therein, locator dowel pins between the end cap and housing and positioned in the slots of the valve plate ears with the aligning tabs at the other end of the tubular member being in spaced pairs and with a pair thereof positioned with a valve plate ear therebetween, and means attaching said end cap and housing together.

Still another object of the invention is to provide a method of assembling a hydraulic displacement unit having a housing with a cavity and with longitudinal recesses defining a plurality of supporting shoulders, means defining a swash surface, a cylinder block rotatable with a shaft and with a plurality of axially movable pistons extending from said cylinder block and each having a slipper with a foot engaging said swash surface, an annular slipper retainer for engagement with said slippers, slipper retainer bearing means for holding said annular slipper retainer against said slipper feet and having a plurality of outwardly-extending peripheral tabs, a tubular member having aligning means at one end thereof and having windows to receive the peripheral tabs of the slipper retainer bearing means, said tubular member having deformable means at the end opposite said alignment means, an end cap for closing said cavity, comprising, positioning the end cap in an upright position, placing the cylinder block on the valve plate, positioning the tubular member on the end cap with the deformable means engaging said end cap and with the windows and aligning means extending upwardly, associating the slipper retainer bearing means onto an end of the tubular member with said peripheral tabs in said windows, inserting the pistons in the cylinder block with the pistons held in assembled relation by the annular slipper retainer, and positioning the swash surface defining means relative to the aligning means at the upward end of the tubular member, placing the housing over the cylinder block and its assembled parts and against the end cap with the supporting shoulders of the housing engaging the outer surface of the tubular member and fastening the housing to the end cap to partially deform said deformable means to take up tolerances between the aforesaid parts.

A further object of the invention is to provide a method of assembling a hydraulic displacement unit having, a housing with a cavity and with an internal inclined wall at one end of the cavity having an aligning recess and with longitudinal recesses defining a plurality of supporting shoulders, a thrust plate positioned against said internal inclined wall to define a swash surface and having a projection with a slot and at least one generally diametrically opposite slot, a cylinder block on a rotatable shaft with a plurality of axially movable pistons extending from said cylinder block and each having a slipper with a foot engaging said swash surface, an annular slipper retainer for engagement with said slippers, an annular slipper retainer bearing for holding said annular slipper retainer against said slipper feet and having a plurality of outwardly-extending peripheral tabs, a tubular member having aligning tabs extending from each end thereof with the aligning tabs at one end positioned in the slots of the thrust plate and having windows to receive the peripheral tabs of the annular slipper retainer bearing, the aligning tabs at the other end of the tubular member being interspersed with short deformable fingers, an end cap for closing said cavity, a valve plate positioned between the end cap and the housing and having a pair of ears with slots therein, locator dowel pins between the end cap and housing and positioned in the slots of the valve plate ears with the aligning tabs at the other end of the tubular member being in spaced pairs and with a pair thereof positioned with a valve plate ear therebetween comprising, placing the end cap in an upright position with the locator dowel pins extending upwardly therefrom, placing the valve plate onto the end cap by placing the valve plate ear slots onto the locator dowel pins, placing the cylinder block on the valve plate, positioning the tubular member on the end cap with the pairs of aligning tabs at said other end thereof guided onto the valve plate ears, placing the annular slipper retainer bearing onto an end of the tubular member with said peripheral tabs in said windows, placing the pistons in the cylinder block with the pistons held in assembled relation by the annular slipper retainer, placing the thrust plate against the slipper feet with the aligning tabs at said one end of the tubular member in the slots of the thrust plate, lowering the housing onto the end cap with the thrust plate projection in the aligning recess of the housing and with the tubular member peripherally engaging the supporting shoulders of the housing, tightening fastening means interconnecting the housing and end cap for drawing the end cap and housing together to crush the deformable fingers of the tubular member and retain the aforesaid structure in assembled relation, and inserting said rotatable shaft through said cylinder block into associated relation with the housing and end cap.

BEST MODES FOR CARRYING OUT THE INVENTION

Figure 1:
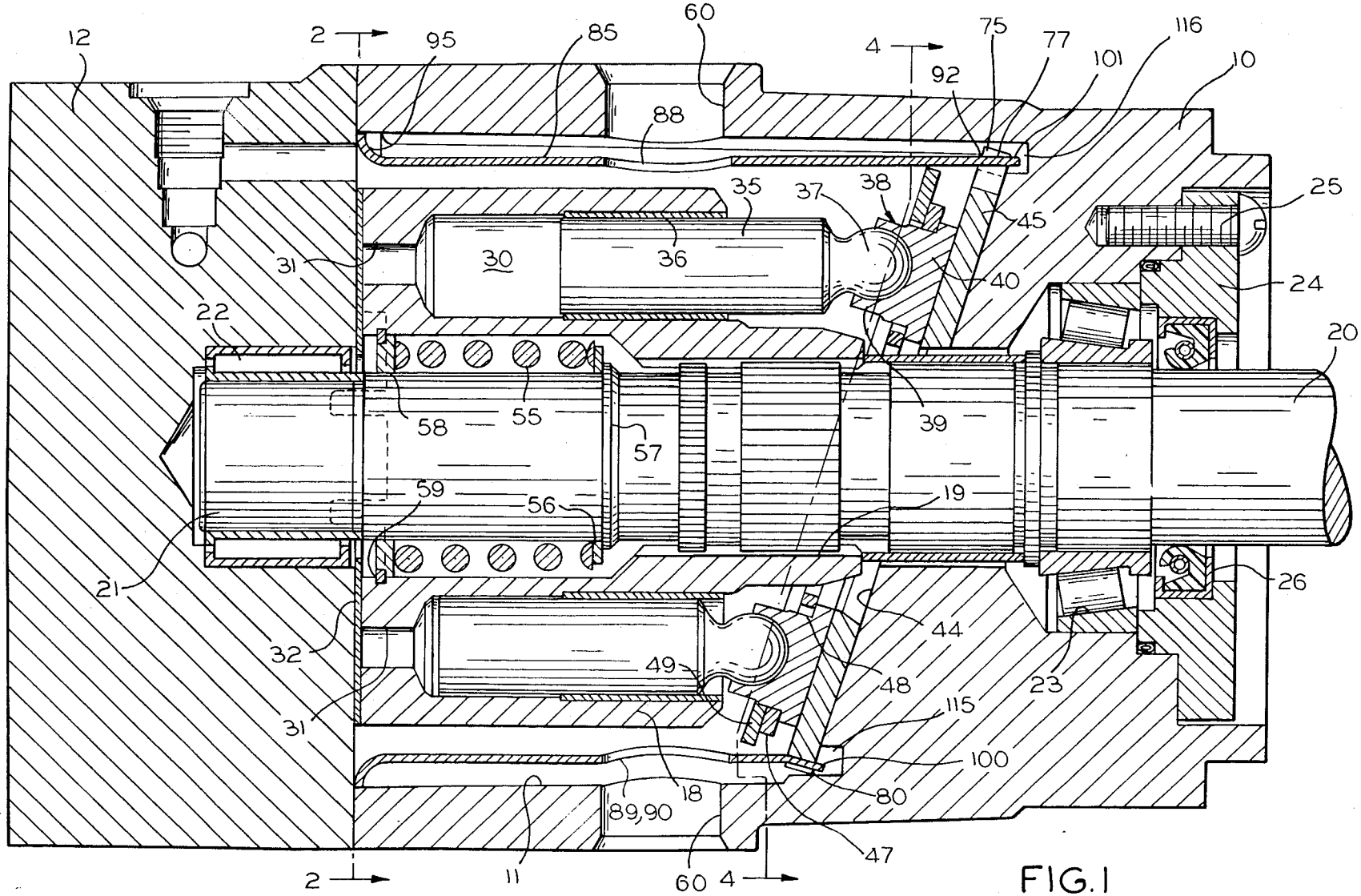
FIG. 1 is a central longitudinal section of the hydraulic displacement unit which is of the axial piston fixed displacement type.

The basic components of a hydraulic displacement unit of the axial piston fixed displacement type are shown particularly in FIGS. 1 to 6.

The unit has a housing 10 with a cavity 11 closed by an end cap 12 and with fastening members in the form of bolts 15 circumferentially spaced about the housing and end cap and attaching these parts together in assembled relation.

A rotatable cylinder block 18 is positioned within the housing cavity 11 and has an internal bore splined at 19 to a rotatable shaft 20 which can be a driven shaft when the hydraulic displacement unit is to operate as a pump and a drive shaft when the unit is operating as a motor.

The shaft 20 has a reduced diameter end 21 rotatably supported in a bearing 22 in the end cap 12. A thrust bearing 23 mounted in a recess in the housing 10 also rotatably supports and axially locates the shaft, with the bearing 23 being held in the recess by a plate 24 secured to the housing end by fastening means, with one of these fastening means being shown as the bolt 25. A seal 26 surrounds the shaft 20 and seals the interior of the housing cavity.

The cylinder block 18 has a series of piston chambers 30 spaced about the axis of rotation of the shaft 20, each of which has an opening 31 to a valve plate 32 positioned against the end cap 12. Each of the piston chambers 30 has a piston 35 reciprocal therein within a sleeve bearing 36. The pistons 35 can be of a conventional construction, with a spherical end 37 rockably mounting a slipper, indicated generally at 38. A cylindrical part 39 of the slipper has a spherical recess to receive the spherical end 37 of the piston and a slipper foot 40 is engageable with a swash surface which controls the reciprocal movement of the pistons.

The swash surface can be formed integrally with the housing or defined by a member positioned within the housing. As shown, the housing cavity has an inclined end wall 44 provided with a counterbore into which a thrust plate 45 is mounted with the thrust plate defining a swash surface engaged by the slipper feet 40.

The slippers 38 are associated with the thrust plate 45 in a fixed maximum clearance relation. An annular slipper retainer 47 shaped similarly to a telephone dial has a series of openings 48 for each loosely receiving a cylindrical part 39 of a slipper 38. An annular slipper retainer bearing 49 engages the outer periphery of the slipper retainer 47. Unique structural features of the thrust plate 45 and the annular slipper retainer bearing 49 will be described subsequently in connection with associated structure to achieve ease of assembly and the fixed maximum clearance of the slipper feet to the thrust plate.

Figure 2:
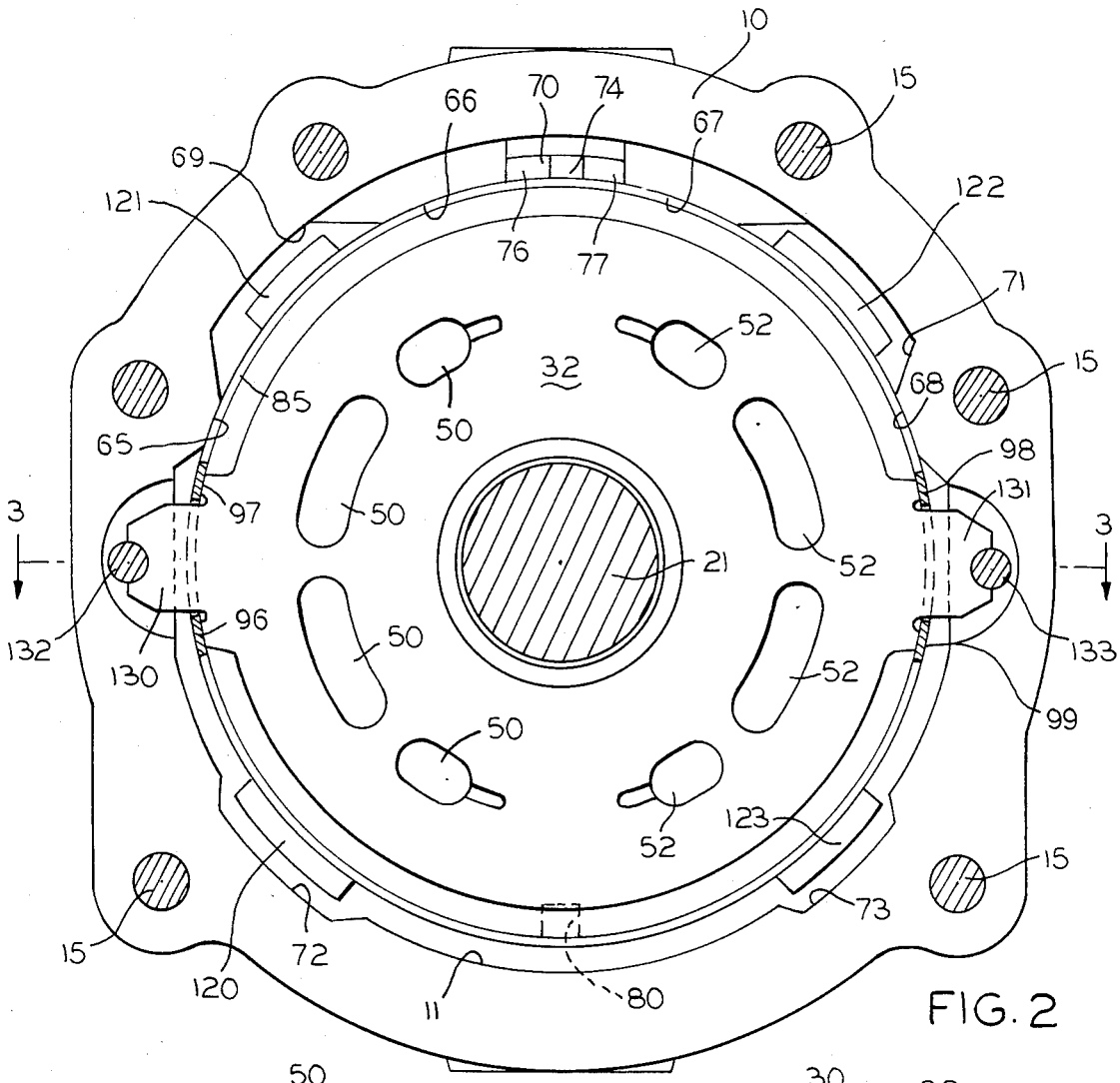
FIG. 2 is a sectional view, taken generally along the line 2—2 in FIG. 1.

The valve plate 32, as seen in FIG. 2, has a series of ports 50 connecting successively with the piston chamber openings 31 as the cylinder block 18 rotates relative to the valve plate and these ports communicate with a fluid passage 51 in the end cap 12. Additional ports 52 in the valve plate 32 communicate successive piston chambers 30, during rotation of the cylinder block 18, with a passage 53 in the end cap 12. The cylinder block 18 is firmly pressed against the valve plate 32 by a compression spring 55 coacting between a ring 56 abutting a shoulder 57 on the shaft 20 and a ring 58 held in association with the cylinder block by an annular spring clip 59.

The housing 10 has radial passages 60 through the wall thereof providing for draining of oil from the housing cavity 11.

The foregoing structure is typical of a hydraulic displacement unit which is of the fixed displacement axial piston type. The unit may operate as a motor, with fluid under pressure being supplied through one of the passages 51 and 53 of the end cap to the piston chambers for driving of the shaft 20, or may operate as a pump with the shaft 20 being driven and one of the passages 51 and 53 in the end cap being connected to a source of fluid and the other passage being connected to a utilization line for the pumped fluid.

A number of the described components have special structural features, simplifying and improving the construction of the unit as well as enabling accurate assembly in a simple manner with retention of the components in assembled relation solely by securing the end cap 12 to the housing 10 and with achievement of a fixed clearance between the slipper feet 40 and the swash surface defined by the thrust plate 45.

An additional result derived from the component assembly is the ease with which a part may be replaced.

The interior wall of the housing 10 defining the cavity 11 has a contour, as seen in FIG. 2, with a series of spaced shoulders 65, 66, 67, and 68 extending lengthwise of the cavity and defining a series of recesses 69, 70, and 71 therebetween which terminate short of the thrust plate 45.

An additional pair of recesses 72 and 73 are formed longitudinally of the cavity. An aligning recess 74 is formed in the end wall 44. The thrust plate 45 is positioned within the counter-bore in the end wall 44 of the housing and has a projection 75 with a slot to define a pair of tabs 76 and 77 which closely fit in the aligning recess 74 in the housing end wall. The projection 75 rotationally orients the thrust plate relative to the housing. The thrust plate additionally has a slot 80 diametrically opposite the projection 75.

Figures 6, 7, 8, 9:
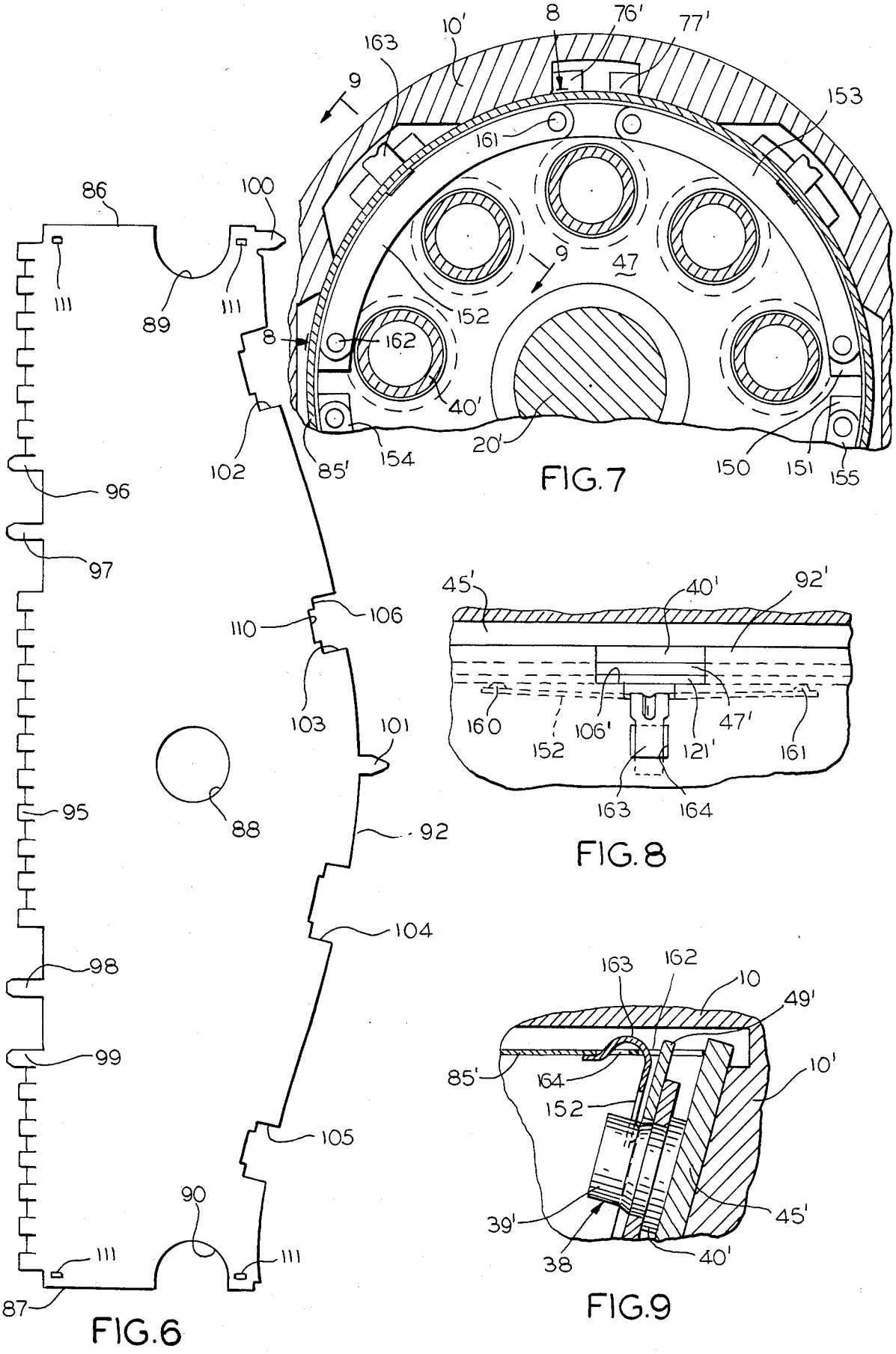
FIG. 6 is a plan view showing a tubular member defining a component of the hydraulic displacement unit in a rolled-out flat pattern.
FIG. 7 is a fragmentary sectional view, similar to FIG. 4, showing one embodiment of spring retention mechanism usable in the hydraulic displacement unit.
FIG. 8 is a sectional view, taken generally along the curved section line 8—8 in FIG. 7.
FIG. 9 is a sectional view, taken generally along the line 9—9 in FIG. 7.

A tubular member 85 is positioned within the housing cavity and extends between the thrust plate 45 and the end cap 12. For illustrative purposes, the tubular member 85 is shown laid out in a flat pattern in FIG. 6. Opposite ends 86 and 87 are brought together and attached to each other when the tubular member is shaped to its tubular form. As seen in FIG. 6, the body of the tubular member has an opening 88 as well as partial openings 89 and 90 (which are joined) to communicate the space within the tubular member with the housing passages 60. The tubular member 85 in flat form is shaped with a curved end surface 92 whereby when rolled into tubular form it has a flat end face with a slope matching the slope of the thrust plate 45.

At one end of the tubular member, there is a formed series of fingers 95 which are interrupted by two spaced pairs of aligning tabs, with one pair shown at 96 and 97 and the other pair shown at 98 and 99. The curved end 92 of the flattened tubular member 85 is formed with a pair of aligning tabs 100 and 101 and with a series of windows 102, 103, 104 and 105 each having an edge 106 set back from the curved surface 92 and provided with an optionally usable spring-mounting recess 110 set in from the edge 106 and which is of a narrower width than the window. The windows 102 and 104 are wider than the windows 103 and 105.

The tubular member is shaped by rolling-up the formed sheet shown in FIG. 6 into a tube and assembling the ends together by welding with a gusset plate at the joinder or by fasteners extending through openings 111 at opposite ends thereof. The tubular member has a length greater than the distance between the surface of the thrust plate 45 and the end cap when the latter is assembled to the housing and the assembly thereof results in crushingly deforming the fingers 95, which have an initial slight outward bend, further outwardly into a clearance area provided within the housing cavity, as seen in FIG. 1, and with the end surface 92 of the tubular member engaging the face of the thrust plate 45, at spaced locations including adjacent the projection 75. The aligning tabs 100 and 101, at the thrust plate end of the tubular member, orient the tubular member with the thrust plate 45 by extending through the thrust plate slot 80 and the slot between the pair of tabs 76 and 77, respectively. A pair of clearance recesses are formed in the end wall 44 of the housing to receive the ends of the tabs 100 and 101, with these clearance recesses being identified at 115 and 116.

The aligning tab 100 is bent at an angle, as seen in FIG. 1, and has the important function of coacting with the thrust plate 45 to prevent movement of the tubular member upwardly, as viewed in FIG. 1.

Figure 4:
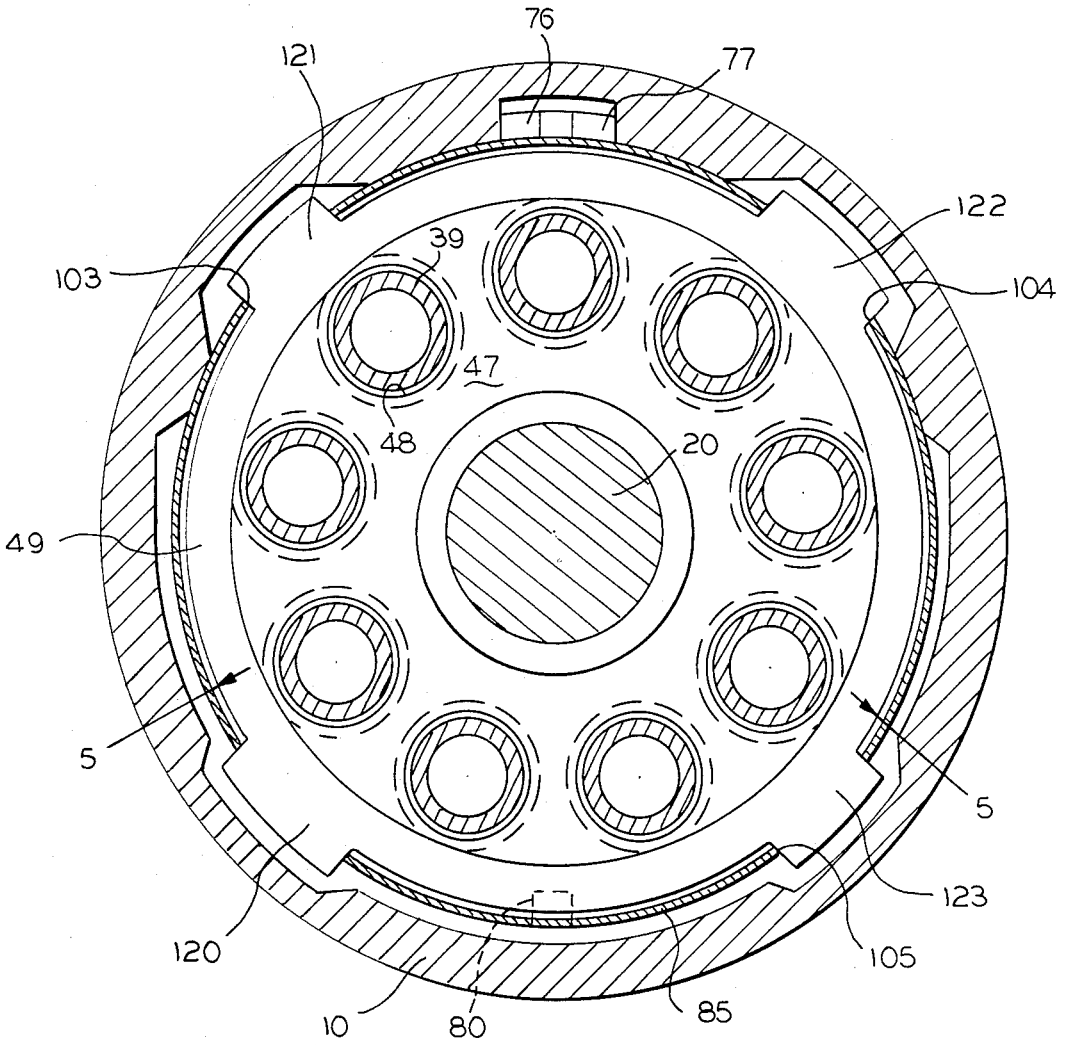
FIG. 4 is a sectional view, taken generally along the line 4—4 in FIG. 1.
Figure 5:
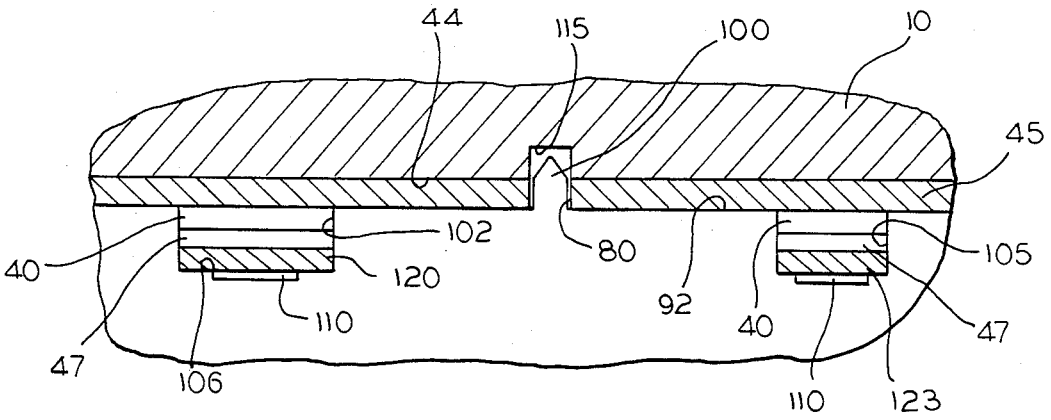
FIG. 5 is a fragmentary sectional view, taken generally along the line 5—5 in FIG. 4.

The annular slipper retainer bearing 49 is shown in FIG. 4 as of a one-piece construction and has a radial width to overlie the slipper retainer 47 and has a plurality of outwardly-extending peripheral tabs 120–123 of two differing widths which are positioned in the windows 102–105, respectively, of the tubular member and engage the edges 106 thereof. As seen in FIG. 5, the tubular member 85 has its end surface 92 engaging the face of the thrust plate 45 to position the window edges 106 at a fixed distance from the face of the thrust plate. The fixed maximum clearance of the slippers is then defined by the height of the windows 102–105 and the thickness of the slipper foot 40, the slipper retainer 47, and the outwardly-extending peripheral tabs 120–123 of the annular slipper retainer bearing.

In order to assure placement of the proper face of the annular slipper retainer bearing 49 against the annular slipper retainer 47, there is less than equal spacing between the windows 102–105 and the outwardly-extending peripheral tabs 120–123 and the differing widths thereof. More particularly, there can be equal spacing between the windows 102–104 and the peripheral tabs 120–122, with the spacing to the window 105 and peripheral tab 123 not being equal to the other spacing, whereby the annular spherical retainer bearing 49 can only be assembled in the proper relation.

Figure 3:
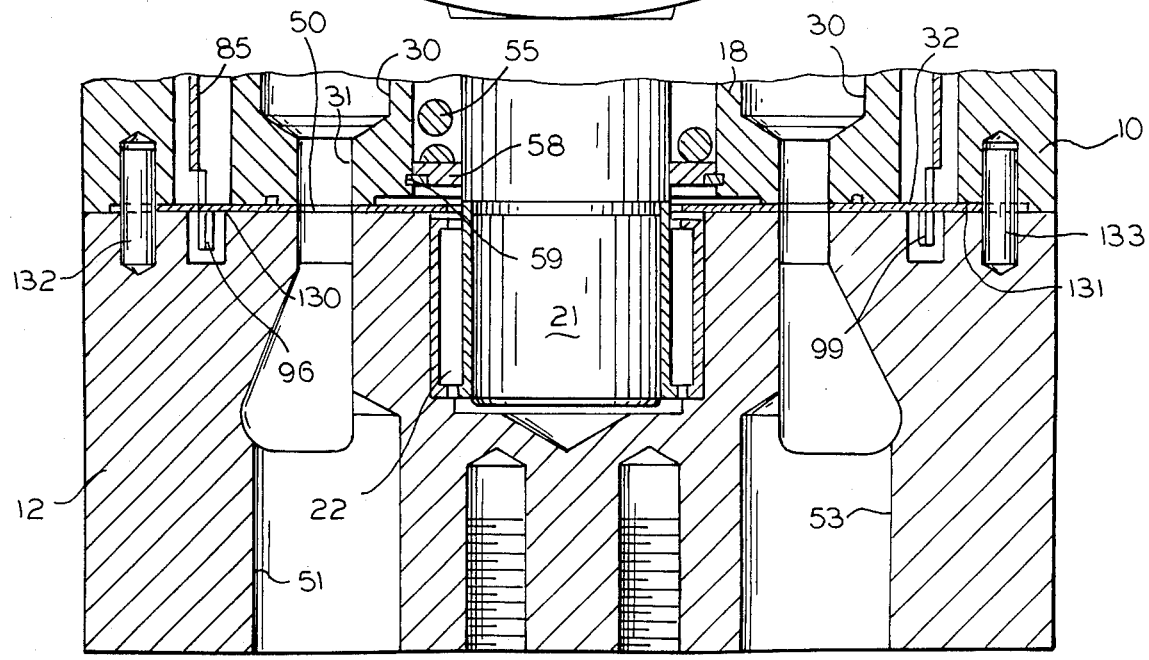
FIG. 3 is a fragmentary sectional view, taken generally along the line 3—3 in FIG. 2.

The valve plate 32, as seen particularly in FIGS. 2 and 3, has a pair of outwardly-extending ears 130 and 131, each having a slot or notch to coact with a locator dowel pin which extends between the housing 10 and the end cap 12. A locator dowel pin 132 coacts with the valve plate ear 130 and a locator dowel pin 133 coacts with the valve plate ear 131. The aligning tabs 96–99 at an end of the tubular member which are interspersed with the fingers 95 coact with the valve plate ears to achieve alignment therebetween, with the aligning tabs 96 and 97 spanning the valve plate ear 130 and the aligning tabs 98 and 99 spanning the valve plate ear 131, as seen in FIG. 2.

The structure of the hydraulic displacement unit, which has now been described, provides a unit of minimum size and also provides for ease of assembly and disassembly for repair and reassembly.

In the method of assembling the hydraulic displacement unit, the end cap is supported in position with the locator dowel pins 132 and 133 extending upwardly therefrom and the valve plate is placed in association therewith in a predetermined orientation by the valve plate ears 130 and 131 which coact with the dowel locator pins 132 and 133. The cylinder block 18 with the rings 56 and 58 and spring 55 assembled thereto is positioned on the valve plate without shaft 20 in association therewith.

The tubular member 85 is then placed upon the upwardly-facing surface of the end cap 12 and rotatably oriented by alignment of the spaced pairs of alignment tabs 96,97 and 98,99, with the valve plate ears 130 and 131. The next step is placing the annular slipper retainer bearing 49 onto the tubular member 85, with the peripheral tabs 120–123 thereof positioned in the windows of the tubular member and with the assured proper mounting of the slipper retainer bearing because of the unequal positioning of one window and one tab and the differing widths, as previously described.

A sub-assembly of the pistons 35 with the slippers 38 and the annular slipper retainer 47 is then lowered as a unit to place the pistons in the piston chambers 39 in the cylinder block and bring the slipper retainer 47 into contact with the slipper retainer bearing 49. Thrust plate 45 is then placed against the feet 40 of the slippers and is oriented relative to and held to the tubular member 85 by the alignment tab 101 which engages in the slot between the tabs 76 and 77 of the projection on the thrust plate 45 and the placement of the tab 100 in the slot 80 in the thrust plate.

The housing 10 is then lowered toward the end cap on which a thin gasket (not shown) may be placed, with the thrust plate projection having the tabs 76 and 77 captured in the aligning recess 74 in the end wall of the housing and with the shoulders 65, 66, 67 and 68 on the interior wall of the housing engaging the external surface of the tubular member and with the outwardly-extending peripheral tabs 120–123 of the slipper retainer bearing positioned within the recesses 69, 71, 72 and 73 of the housing interior wall. The locator dowel pins 132 and 133 accurately align the housing to the end cap.

As stated before, the tubular member 85 has a length greater than the distance between the surface of the thrust plate and the surface of the end cap when the unit is fully assembled. The drawing together of the housing and end cap results in a crushing deformation of the fingers 95 to firmly fix the tubular member with the end surface 92 thereof engaging the thrust plate and the crushing of the fingers resulting in taking up manufacturing tolerances.

The crushing of the fingers causes a plastic deformation of the material with some elasticity remaining. As an example and without limiting the disclosure, the tubular member 85 can be formed from a sheet of 1074 special tempered steel of 20 gauge thickness. Another possible material is M160 Martensite produced by Inland Steel.

The plastic or permanent deformation takes up most of the tolerance in the unit housing while leaving the spring of the elastic deformation of the fingers 95 to provide a spring bias on the thrust plate 45. This spring or elastic deformation also permits some tolerance take up with a slightly different thrust plate thickness during a later repair that might require replacement of the original thrust plate 45.

An important feature is the deformation of the fingers 95 with remaining spring bias. If the fingers 95 were merely spring fingers without deformation, the length thereof would have to be increased in order to have sufficient tolerance take-up by spring action alone. This would require an increase in the diameter of the housing cavity 11 with a corresponding increase in the bolt span and size of the end cap. Permanent deformation avoids this problem.

As the housing and end cap are drawn together, the slope of the thrust plate forces the tubular member 85 against the housing shoulders 65–68.

One example of an alternative to the use of the fingers that can be crushed, would be the use of a wave-spring between the end cap and the adjacent end of the tubular member. The drawing of the end cap and housing together into assembled relation is achieved by tightening the fastening bolts 15, shown in FIG. 2, and, thereafter, the shaft 20 can be inserted through the components including the cylinder block 18 to place the end 21 thereof within the bearing 22 in the end cap. The shaft has sections of gradually-reducing diameter in order to achieve the endwise insertion, either upon initial assembly or upon replacement of a shaft. After placement of the shaft 20, the plate 24 is attached and fastened to the housing to capture the thrust bearing 23 and the shaft 20.

It is optional to provide for spring-loading of the slippers against the thrust plate 45, with four different embodiments of structure for achieving this optional spring loading being shown in the drawings.

A first embodiment is shown in FIGS. 7–9. Basic components of the previously-described pump, shown in this embodiment, are given the same reference numeral with a prime affixed thereto. In this embodiment, the annular slipper retainer bearing 49' is formed of two semicircular sections 150 and 151 and there are a series of arcuate leaf springs associated with the sections of the slipper retainer bearing. The arcuate leaf springs 152 and 153 coact with the arcuate slipper retainer bearing section 150 and with portions of arcuate leaf springs 154 and 155 shown in association with the slipper retainer bearing section 151. Each of the springs is of the same construction, with the spring 152 being shown particularly in FIGS. 8 and 9. Opposite ends of the leaf spring have a pair of spherical buttons 160 and 161 which engage the slipper retainer bearing section. 150. A central leg 162 extends through the spring-mounting recess 110' associated with the window in the tubular member 85' and which is of a deeper depth than the spring-mounting recesses 110, shown in FIG. 5. A curved end 163 of the leg is positioned within another opening 164 in the tubular member 85' to lock the spring to the tubular member. With this construction, the fixed maximum clearance between the slippers and the thrust plate 45' is still achieved and with spring-loading of the slippers assisting in preventing tipping thereof at relatively low operating speeds.

Figure 10:
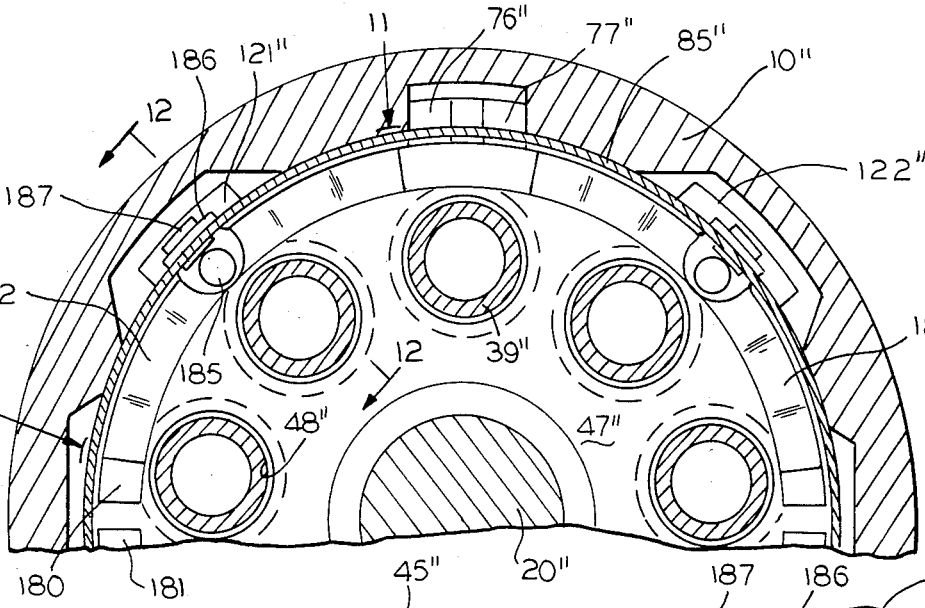
FIG. 10 is a fragmentary sectional view, similar to FIG. 7, of a second embodiment of spring retention structure used in the hydraulic displacement unit.
Figure 11:
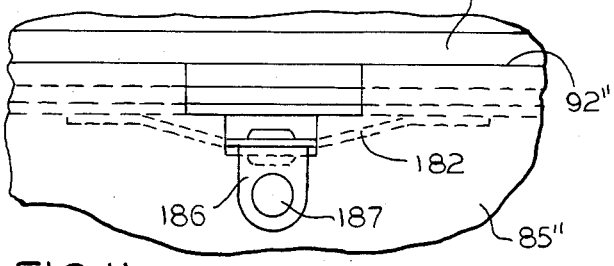
FIG. 11 is a sectional view of the second embodiment, taken generally along the curved section line 11—11 in FIG. 10.
Figure 12:
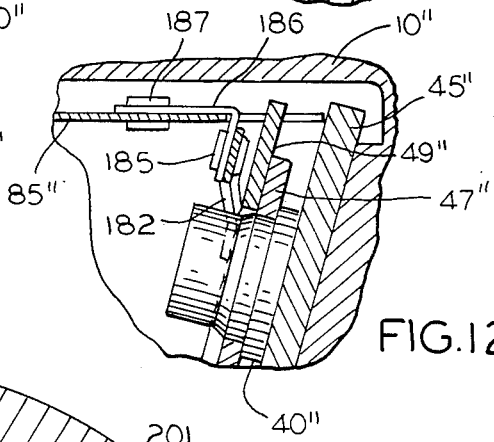
FIG. 12 is a fragmentary sectional view of the second embodiment, taken generally along the line 12—12 in FIG. 10.

A second embodiment of spring-loading for the slippers is shown in FIGS. 10–12 wherein unit components comparable to those described in connection with FIGS. 1–6 are given the same reference numeral with a double prime affixed thereto.

In this embodiment, the annular slipper retainer bearing is again shown formed as a pair of semicircular sections 180 and 181 and with arcuate leaf springs being positioned for resilient engagement with the slipper retainer bearing sections 180 and 181. The arcuate springs 182 and 183 are shown in association with the slipper retainer bearing section 180. In this embodiment, the arcuate spring 182 is attached by a rivet 185 to an angled bracket 186 which extends through a spring-mounting recess 110'' and is secured to the tubular member 85'' by means of a rivet 187.

Figure 13:
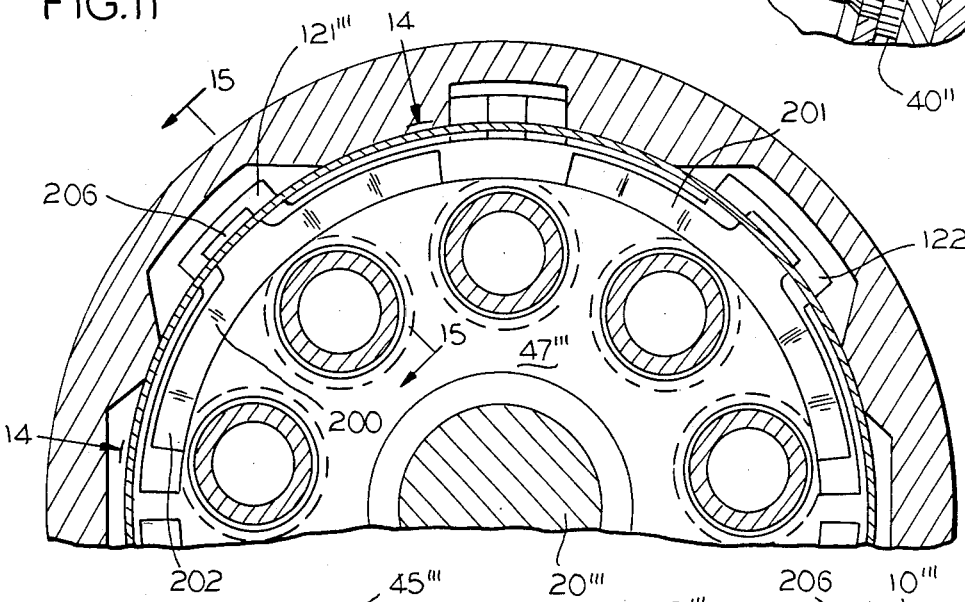
FIG. 13 is a fragmentary sectional view, similar to FIG. 4, showing a third embodiment of spring retention structure.
Figure 14:
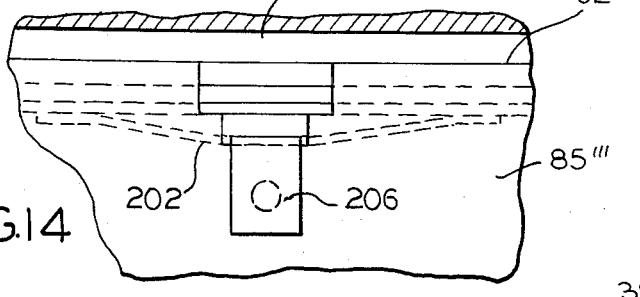
FIG. 14 is a fragmentary sectional view of the third embodiment, taken generally along the curved section line 14—14 in FIG. 13.
Figure 15:
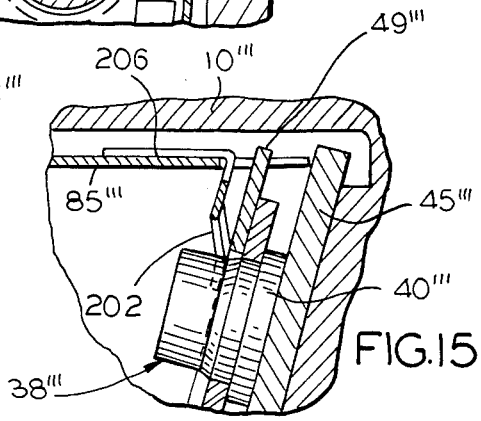
FIG. 15 is a fragmentary sectional view of the third embodiment, taken generally along line 15—15 in FIG. 13.

A third embodiment of spring means for exerting force on the slippers is shown in FIGS. 13–15, wherein components comparable to those described in connection with the unit of FIGS. 1–6 have been given the same reference numeral with a triple prime affixed thereto.

This embodiment is similar to the first embodiment of FIGS. 7–9 wherein arcuate leaf springs coact with a segmented slipper retainer bearing, with the arcuate leaf springs 200 and 201 coacting with the slipper retainer bearing section 202. A leg 205 extends from the spring 200, as seen in FIGS. 14 and 15, and passes through a spring-mounting recess 110''' associated with the window at the end of the tubular member 85''' and has its outer end secured to the exterior or the tubular member 85''' as by a weld, as shown at 206.

Figure 16:
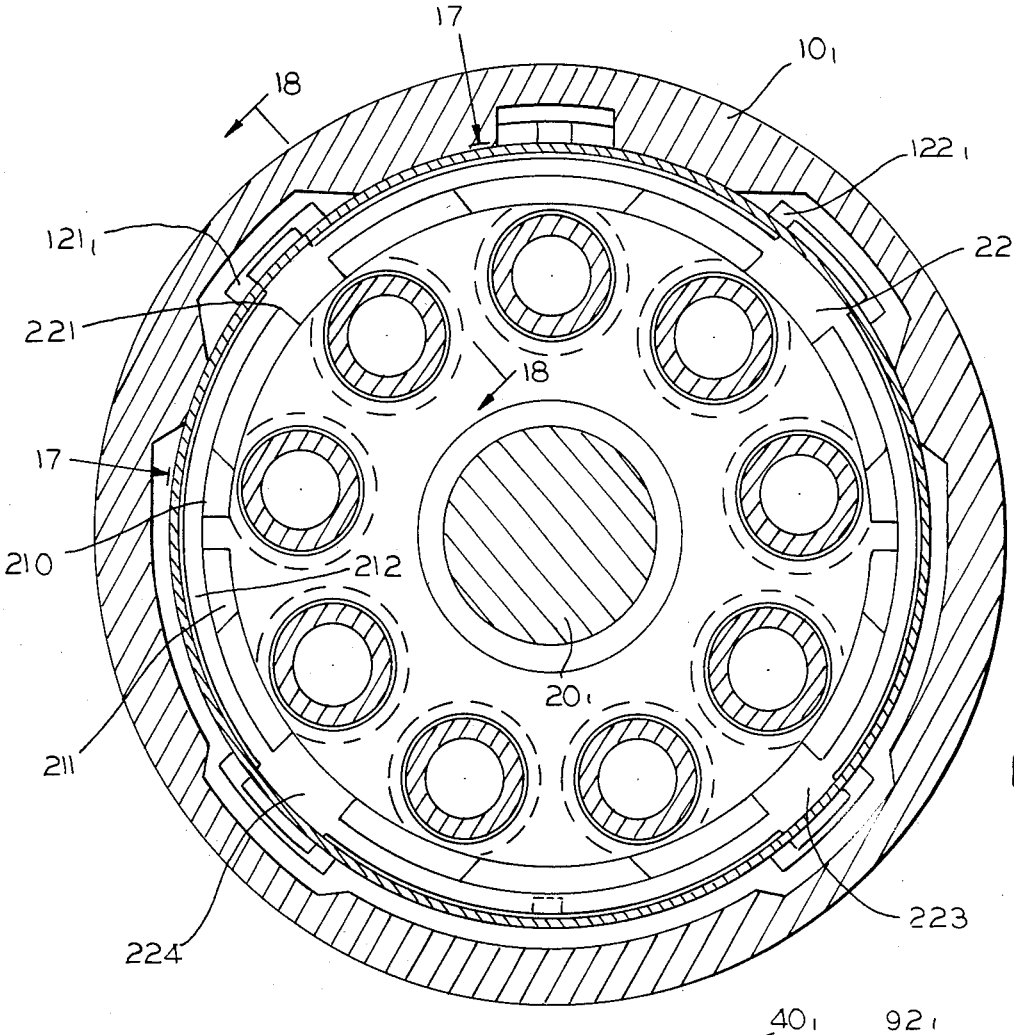
FIG. 16 is a fragmentary sectional view, similar to FIG. 4, of a fourth embodiment of optional spring retention structure.
Figure 17:
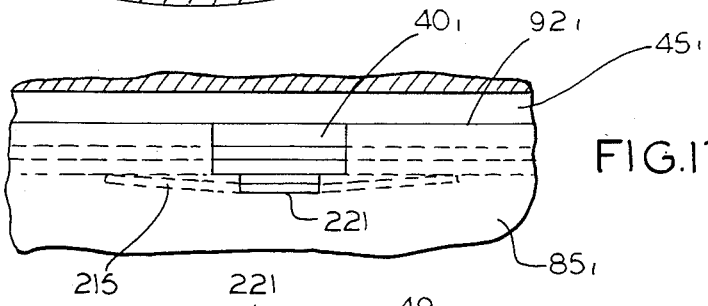
FIG. 17 is a fragmentary sectional view of the fourth embodiment, taken generally along the curved section line 17 in FIG. 16.
Figure 18:
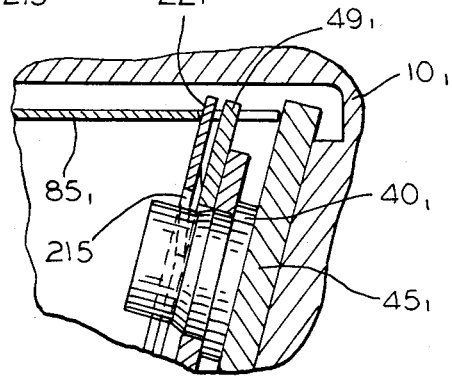
FIG. 18 is a fragmentary sectional view of the fourth embodiment, taken generally along the line 18—18 in FIG. 16.

A fourth embodiment of spring means for exerting force on the slippers is shown in FIGS. 16–18 wherein the same components as those described in connection with the unit of FIGS. 1–6 are given the same reference numeral with a subscript 1 associated therewith.

In this embodiment, the annular slipper retainer bearing is defined by two arcuate sections 210 and 211 and the spring means is defined by an annular spring 212 having outwardly extending peripheral feet comparable to the peripheral tabs 120–123 of the annular slipper retainer bearing 49, but of a narrower width to fit in the spring-mounting recesses $110_1$ of the tubular member $85_1$. Sections 215 of the spring are out of the plane thereof to press against the slipper retainer bearing sections. The peripheral feet are shown at 221, 222, 223, and 224. To assure proper mounting of the annular spring 212, the peripheral foot 223 is angularly offset relative to the other peripheral feet, as previously described in connection with the peripheral tabs 120–123, to assure that the spring 212 can only be mounted in a position with the deflected spring sections 215 positioned against the slipper retainer bearing. sections 210 and 211.

In all four embodiments of the slipper-engaging spring structure, the slipper retainer bearing is shown of two-piece construction which is optional and it could be a continuous annular member, as shown in FIG. 4.

With the foregoing constructions, a hydraulic displacement unit of the axial piston fixed displacement type can have components assembled with slippers having fixed maximum clearance relative to a swash surface as defined by a thrust plate, with the assembled components not requiring any internal attaching structure. A tubular member can be captured between the thrust plate and an end cap when the end cap and housing for the components are brought into assembled relation. This reduces the size of the cavity required in the housing for the components. No bolts are required for attaching a slipper retainer bearing to the housing and, therefore, there is no clearance required for access of a tool for tightening the bolts. This makes the unit more radially compact and reduces the size of the end cap required to enclose the housing cavity and reduces the bolt span for attaching bolts which secure the housing and end cap together. This makes the end cap more rigid for a particular thickness thereof and reduces the possible end cap deflection from internal forces and, thus minimizes adverse effects on both internal and external leakage and efficiency.

In addition to ease of assembly, there is ease of disassembly for repair and replacement of worn parts with reassembly thereafter.

I claim:

1. A hydraulic displacement unit of the fixed displacement type having a housing with a cavity, a rotatable cylinder block in said housing cavity and carrying a plurality of pistons axially reciprocable in chambers in said cylinder block as the cylinder block rotates, an inclined swash surface at one end of said cavity, an end cap for closing said cavity, means for securing said end cap to said housing, a slipper associated with each of said pistons and each having a slipper foot engageable with said inclined swash surface for controlling the axial stroke of said pistons, an annular slipper retainer bearing, an annular slipper retainer associated with said slippers and captured between said annular slipper retainer bearing and the slipper feet, a tubular member compressively captured between said swash surface and said end cap, with an end of the tubular member engaging said swash surface, and interengaging means on said tubular member at a distance from said end thereof and on said retainer bearing to provide a fixed maximum clearance between the slippers and the swash surface.

2. A unit as defined in claim 1 wherein said interengaging means includes spring means associated with the tubular member for urging the annular slipper retainer bearing toward the swash surface.

3. A unit as defined in claim 2 wherein said spring means comprises an annular spring.

4. A unit as defined in claim 2 wherein said spring means comprises a plurality of springs attached to said tubular member.

5. A hydraulic displacement unit of the fixed displacement type having a housing with a cavity, a rotatable cylinder block in said housing cavity and carrying a plurality of pistons axially reciprocable in chambers in said cylinder block as the cylinder block rotates, an inclined swash surface at one end of said cavity, an end cap for closing said cavity, means for securing said end cap to said housing, a slipper associated with each of said pistons and each having a slipper foot engageable with said inclined swash surface for controlling the axial stroke of said pistons, an annular slipper retainer bearing, an annular slipper retainer associated with said slippers and captured between said annular slipper retainer bearing and the slipper feet, and a tubular member captured between said swash surface and said end cap and coacting with said retainer bearing to provide a fixed maximum clearance between the slippers and the swash surface, said tubular member having a plurality of windows at an end thereof and said annular slipper retainer bearing having a plurality of peripheral tabs which are positioned one in each of said windows and extend radially outward of the tubular member.

6. A unit as defined in claim 5 wherein said housing has an internal wall defining said cavity, and said internal wall having a contour with shoulders and intermediate recesses extending lengthwise thereof with the recesses receiving said peripheral tabs on the slipper retainer bearing.

7. A unit as defined in claim 5 wherein said windows and peripheral tabs are of differing widths and all but one of said windows and all but one of said peripheral tabs are equally spaced apart to assure correct orientation of the slipper retainer bearing and the tubular member by requiring location of the unequally-spaced peripheral tab in the unequally-spaced window.

8. A hydraulic displacement unit of the fixed displacement type having a housing with a cavity, a rotatable cylinder block in said housing cavity and carrying a plurality of pistons axially reciprocable in chambers in said cylinder block as the cylinder block rotates, an inclined swash surface at one end of said cavity, an end cap for closing said cavity, means for securing said end cap to said housing, a slipper associated with each of said pistons and each having a slipper foot engageable with said inclined swash surface for controlling the axial stroke of said pistons, an annular slipper retainer bearing, an annular slipper retainer associated with said slippers and captured between said annular slipper retainer bearing and the slipper feet, a tubular member captured between said swash surface and said end cap and coacting with said retainer bearing to provide a fixed maximum clearance between the slippers and the swash surface, said swash surface being defined by an inclined surface on the housing and a thrust plate positioned against said inclined surface, aligning tab means on an end of said tubular member interfitted with said thrust plate, and a projection on said thrust plate positionable in an opening in said housing for rotational orientation of the thrust plate relative to the housing and to prevent rotation of the thrust plate.

9. A unit as defined in claim 8 wherein said thrust plate has a pair of peripherally-spaced tab-receiving openings, and said aligning tab means on the tubular member comprises a pair of peripherally-spaced tabs positionable one in each of said tab-receiving openings and one of said tabs coacting with the thrust plate to prevent movement of the tubular member transversely of the cylinder block.

10. A hydraulic displacement unit of the fixed displacement type having a housing with a cavity, a rotatable cylinder block in said housing cavity and carrying a plurality of pistons axially reciprocable in chambers in said cylinder block as the cylinder block rotates, an inclined swash surface at one end of said cavity, an end cap for closing said cavity, means for securing said end cap to said housing, a slipper associated with each of said pistons and each having a slipper foot engageable with said inclined swash surface for controlling the axial stroke of said pistons, an annular slipper retainer bearing, an annular slipper retainer associated with said slippers and captured between said annular slipper retainer bearing and the slipper feet, and a tubular member captured between said swash surface and said end cap and coacting with said retainer bearing to provide a fixed maximum clearance between the slippers and the swash surface, said tubular member being longer than the distance between the swash surface and the end cap and having a series of integral fingers at an end thereof adjacent the end cap and said tubular member being formed of a material whereby said fingers can be permanently deformed with retained elasticity when the end cap is attached to the housing to firmly hold the tubular end against the swash surface.

11. A unit as defined in claim 10 wherein said tubular member has peripherally-spaced pairs of aligning tabs adjacent said integral fingers, a valve plate between said housing and end cap, locator dowel pins between the end cap and housing, a pair of slotted ears on the valve plate to engage said locator dowel pins, and said pairs of aligning tabs spanning said valve plate ears.

12. A hydraulic displacement unit of the fixed displacement type having a housing with a cavity, a rotatable cylinder block in said housing cavity and carrying a plurality of pistons axially reciprocable in chambers in said cylinder block as the cylinder block rotates, an inclined swash surface at one end of said cavity, an end cap for closing said cavity, means for securing said end cap to said housing, a slipper associated with each of said pistons and each having a slipper foot engageable with said inclined swash surface for controlling the axial stroke of said pistons, an annular slipper retainer bearing, an annular slipper retainer associated with said slippers and captured between said annular slipper retainer bearing and the slipper feet, and a tubular member captured between said swash surface and said end cap and coacting with said retainer bearing to provide a fixed maximum clearance between the slippers and the swash surface, said tubular member having a plurality of windows formed in an end thereof adjacent said swash surface, and said annular slipper retainer bearing having peripheral tabs with each window having an edge to engage a peripheral tab to control the maximum distance of the slipper retainer bearing from the swash surface and thus provide said fixed maximum clearance between the slippers and the swash surface.

13. A unit as defined in claim 12 wherein said window edges have a spring-mounting recess of a width less than the window.

14. A unit as defined in claim 13 including an annular spring engaging the slipper retainer bearing and having a plurality of peripheral feet positioned one in each of said spring-mounting recesses.

15. A unit as defined in claim 13 including a plurality of springs engaging the slipper retainer bearing, each of said springs having a part positioned in one of said spring-mounting recesses.

16. A unit as defined in claim 15 wherein said tubular member has an opening adjacent each of said windows and said spring being shaped to clip on the tubular member by having a part extending through said opening.

17. A unit as defined in claim 15 wherein said springs are riveted to said tubular member.

18. A unit as defined in claim 15 wherein each of said springs has a leg positioned outside and attached to said tubular member.

19. A hydraulic fixed displacement unit operable as a pump or motor having a housing with an internal cavity open at one end and a swash surface at the other end, a shaft extending centrally through said cavity, a cylinder block in said cavity and splined to said shaft and having a plurality of axially-extending piston chambers each movably mounting a reciprocal piston, a slipper with a foot associated with each piston, an end cap attached to said housing for closing said cavity, the improvement comprising means for assembling the cylinder block and pistons in said housing with a fixed clearance between the slipper feet and said swash surface and which coacts with an annular slipper retainer bearing and a slipper retainer captured between the slipper feet and the annular slipper retainer bearing, said assembly means including a tubular member surrounding said cylinder block and radially spaced therefrom and compressively fixed between said end cap and said swash surface, said tubular member having circumferentially-spaced windows at an end thereof adjacent the swash surface with edges spaced from the swash surface, and a plurality of circumferentially-spaced tabs at the periphery of the annular slipper retainer bearing positioned in said windows and engaging said edges to thus control the distance of the annular slipper retainer bearing from the swash surface and therefore the maximum clearance between the swash surface and the slipper feet.

20. A hydraulic displacement unit as defined in claim 19 wherein each of said window edges is notched to provide a spring-mounting recess, and spring means mounted on the tubular member to press against said annular slipper retainer bearing and with parts thereof in said spring-mounting recesses.

21. A unit as defined in claim 19 wherein said tubular member has peripherally-spaced pairs of aligning tabs adjacent an end thereof, a valve plate between said housing and end cap, locator dowel pins between the end cap and housing, a pair of slotted ears on the valve plate to engage said locator dowel pins, and said pairs of aligning tabs spanning said valve plate ears.

22. A unit as defined in claim 19 including spring means associated with the tubular member for urging the annular retainer bearing toward the swash surface.

23. A unit as defined in claim 19 wherein said swash surface is defined by a thrust plate, aligning tab means on an end of said tubular member interfitted with said thrust plate, and a locating projection on said thrust plate coacting with said housing for rotational orientation of the thrust plate relative to the housing and to prevent rotation of the thrust plate.

24. A unit as defined in claim 21 wherein said thrust plate has a pair of peripherally-spaced tab-receiving openings, and said aligning tab means on the tubular member comprises a pair of peripherally-spaced tabs positionable one in each of said tab-receiving openings.

25. A unit as defined in claim 19 wherein said tubular member windows each have an edge to engage a peripheral tab to control the distance of the slipper retainer bearing from the swash surface and a spring-mounting recess formed in said edge of width less than the window.

26. A unit as defined in claim 25 including an annular spring engaging the slipper retainer bearing and having a plurality if peripheral feet positioned one in each of said spring-mounted recesses.

27. A hydraulic displacement unit comprising, a housing with a cavity and with an internal inclined wall at one end of the cavity, a thrust plate positioned against said internal inclined wall to define a swash surface and having a projection with a slot and a second diametrically opposite slot, a cylinder block on a rotatable shaft with a plurality of axially movable pistons extending from said cylinder block and each having a slipper with a foot engaging said swash surface, an annular slipper retainer for engagement with said slippers, an annular slipper retainer bearing for holding said annular slipper retainer against said slipper feet and having a plurality of outwardly-extending peripheral tabs, a tubular member having aligning tabs extending from each end thereof with the aligning tabs at one end positioned in the slots of the thrust plate and having windows to receive the peripheral tabs of the annular slipper retainer bearing, the aligning tabs at the other end of the tubular member being interspersed with deformable fingers, and an end cap for closing said cavity and which deforms said fingers upon assembly to take up tolerances between the assembled parts.

28. A unit as defined in claim 27 wherein the rotatable shaft for the cylinder block is rotatably supported by bearings in said housing and end cap, said shaft having progressively reduced diameters for endwise insertion through the cylinder block for association with said bearings.

29. A unit as defined in claim 27 including a valve plate positioned between the end cap and the housing and having a pair of ears with slots therein, locator dowel pins between the end cap and housing and positioned in the slots of the valve plate ears with the aligning tabs at the other end of the tubular member being in spaced pairs and with a pair thereof positioned with a valve plate ear therebetween, and means attaching said end cap and housing together.

30. A unit as defined in claim 27 wherein said deformable fingers have an initial bend and have some elasticity after deformation.

31. A hydraulic displacement unit operable as a pump or motor having a housing with an internal cavity open at one end and a swash surface at the other end, a shaft extending centrally through said cavity, a cylinder block in said cavity and splined to said shaft and having a plurality of axially-extending piston chambers each movably mounting a reciprocal piston, a slipper with a foot associated with each piston, an end cap attached to said housing for closing said cavity, a valve plate with alignment ears interposed between said cylinder block and end cap, the improvement comprising means for assembling the cylinder block and pistons in said housing with a fixed maximum clearance between the slipper feet and said swash surface and which coacts with an annular slipper retainer bearing and a slipper retainer captured between the slipper feet and the annular slipper retainer bearing, said assembly means including a tubular member surrounding said cylinder block and spaced therefrom and compressively fixed between said end cap and said swash surface, said tubular member having circumferentially-spaced windows at an end thereof adjacent the swash surface with edges spaced from the swash surface, and a plurality of circumferentially-spaced tabs at the periphery of the annular slipper retainer bearing positioned in said windows and engaging said edges to thus control the distance of the annular slipper retainer bearing from the swash surface and therefore the clearance between the swash surface and the slipper feet, and aligning tabs on an end of said tubular member for engagement with said valve plate alignment ears.

32. The method of assembling a hydraulic displacement unit having a housing with a cavity and with longitudinal recesses defining a plurality of supporting shoulders, means defining a swash surface, a cylinder block rotatable with a shaft and with a plurality of axially movable pistons extending from said cylinder block and each having a slipper with a foot engaging said swash surface, an annular slipper retainer for engagement with said slippers, slipper retainer bearing means for holding said annular slipper retainer against said slipper feet and having a plurality of outwardly-extending peripheral tabs, a tubular member having aligning means at one end thereof and having windows to receive the peripheral tabs of the slipper retainer bearing means, said tubular member having deformable means at the end opposite said alignment means, an end cap for closing said cavity, comprising, positioning the end cap in an upright position, placing the cylinder block on the end cap with the deformable means engaging said end cap and with the windows and aligning means extending upwardly, associating the slipper retainer bearing means onto an end of the tubular member with said peripheral tabs in said windows, inserting the pistons in the cylinder block with the pistons held in assembled relation by the annular slipper retainer, and positioning the swash surface defining means relative to the aligning means at the upward end of the tubular member, placing the housing over the cylinder block and its assembled parts and against the end cap with the supporting shoulders of the housing engaging the outer surface of the tubular member and fastening the housing to the end cap to partially deform said deformable means to take up tolerances between the aforesaid parts.

33. The method of assembling a hydraulic displacement unit having a housing with a cavity and with longitudinal recesses defining a plurality of supporting shoulders, means defining a swash surface and having a pair of generally diametrically opposite slots, a cylinder block splined to a rotatable shaft with a plurality of axially movable pistons extending from said cylinder block and each having a slipper with a foot engaging said swash surface, an annular slipper retainer for engagement with said slippers, an annular slipper retainer bearing for holding said annular slipper retainer against said slipper feet and having a plurality of outwardly-extending peripheral tabs, a tubular member having aligning tabs extending from each end thereof with the aligning tabs at one end positioned in the generally diametrically opposite slots and having windows to receive the peripheral tabs of the annular slipper retainer bearing, an end cap for closing said cavity, a valve plate positioned between the end cap and the housing and having a pair of ears with slots therein, locator dowel pins between the end cap and housing and positioned in the slots of the valve plate ears with the aligning tabs at the other end of the tubular member being in spaced pairs and with a pair thereof positioned with a valve plate ear therebetween comprising, positioning the end cap in an upright position with the locator dowel pins extending upwardly therefrom, moving the valve plate onto the end cap by placing the valve plate ear slots onto the locator dowel pins, placing the cylinder block on the valve plate, positioning the tubular member on the end cap with the pairs of aligning tabs at said other end thereof guided onto the valve plate ears, associating the annular slipper retainer bearing onto an end of the tubular member with said peripheral tabs in said windows, inserting the pistons in the cylinder block with the pistons held in assembled relation by the annular slipper retainer, and positioning the swash surface defining means relative to the aligning tabs at said one end of the tubular member with the housing placed against the end cap and engaging the locator dowels and the supporting shoulders of the housing engaging the outer surface of the tubular member and fastening the housing to the end cap.

34. The method of assembling a hydraulic displacement unit having, a housing with a cavity and with an internal inclined wall at one end of the cavity having an aligning element and with longitudinal recesses defining a plurality of supporting shoulders, a thrust plate positioned against said internal inclined wall to define a swash surface and having first and second aligning elements, a cylinder block on a rotatable shaft with a plurality of axially movable pistons extending from said cylinder block and each having a slipper with a foot engaging said swash surface, an annular slipper retainer for engagement with said slippers, an annular slipper retainer bearing for holding said annular slipper retainer against said slipper feet and having aligning elements, a tubular member having aligning elements extending from each end thereof with the aligning elements at one end associated with the aligning elements of the thrust plate, an end cap for closing said cavity and having locator means comprising, placing the end cap in an upright position with the locator means extending upwardly therefrom, placing the cylinder block on the end cap, positioning the tubular member on the end cap radially spaced from the cylinder block with the aligning elements at the other end thereof guided relative to the end cap locator means, placing the annular slipper retainer bearing onto an end of the tubular member with the aligning elements of the annular slipper retainer bearing associated with the tubular member, placing the pistons in the cylinder block with the pistons held in assembled relation by the annular slipper retainer, placing the thrust plate against the slipper feet with the aligning elements at said one end of the tubular member associated with the aligning elements of the thrust plate, lowering the housing onto the end cap with a thrust plate aligning element associated with the aligning element of the housing and with the tubular member peripherally engaging the supporting shoulders of the housing, tightening fastening means interconnecting the housing and end cap for drawing the end cap and housing together to capture the tubular member therebetween and retain the aforesaid structure in assembled relation and inserting said rotatable shaft through said cylinder block into associated relation with the housing and end cap.

35. The method of assembling a hydraulic displacement unit having, a housing with a cavity and with an internal inclined wall at one end of the cavity having an aligning recess and with longitudinal recesses defining a plurality of supporting shoulders, a thrust plate positioned against said internal inclined wall to define a swash surface and having a projection with a slot and a second diametrically opposite slot, a cylinder block on a rotatable shaft with a plurality of axially movable pistons extending from said cylinder block and each having a slipper with a foot engaging said swash surface, an annular slipper retainer for engagement with said slippers, an annular slipper retainer bearing for holding said annular slipper retainer against said slipper feet and having a plurality of outwardly-extending peripheral tabs, a tubular member having aligning tabs extending from each end thereof with the aligning tabs at one end positioned in the slots of the thrust plate and having windows to receive the peripheral tabs of the annular slipper retainer bearing, the aligning tabs at the other end of the tubular member being interspersed with short deformable fingers, an end cap for closing said cavity, a valve plate positioned between the end cap and the housing and having a pair of ears with slots therein, locator dowel pins between the end cap and housing and positioned in the slots of the valve plate ears with the aligning tabs at the other end of the tubular member being in spaced pairs and with a pair thereof positioned with a valve plate ear therebetween comprising, placing the end cap in an upright position with the locator dowel pins extending upwardly therefrom, placing the valve plate onto the end cap by placing the valve plate ear slots onto the locator dowel pins, placing the cylinder block on the valve plate, positioning the tubular member on the end cap with the pairs of aligning tabs at said other end thereof guided onto the valve plate ears, placing the annular slipper retainer bearing onto an end of the tubular member with said peripheral tabs in said windows, placing the pistons in the cylinder block with the pistons held in assembled relation by the annular slipper retainer, placing the thrust plate against the slipper feet with the aligning tabs at said one end of the tubular member in the slots of the thrust plate, lowering the housing onto the end cap with the thrust plate projection in the aligning recess of the housing and with the tubular member peripherally engaging the supporting shoulders of the housing, tightening fastening means interconnecting the housing and end cap for drawing the end cap and housing together to crush the deformable fingers of the tubular member and retain the aforesaid structure in assembled relation and inserting said rotatable shaft through said cylinder block into associated relation with the housing and end cap.

* * * * *